US010522069B2

(12) United States Patent
Sato

(10) Patent No.: US 10,522,069 B2
(45) Date of Patent: Dec. 31, 2019

(54) DRIVING DEVICE FOR DRIVING DISPLAY DEVICE, LIQUID CRYSTAL DISPLAY, AND DRIVING METHOD FOR DRIVING DISPLAY DEVICE

(71) Applicant: JVC KENWOOD CORPORATION, Yokohama-shi, Kanagawa (JP)

(72) Inventor: Akihiro Sato, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 0 days.

(21) Appl. No.: 16/152,839

(22) Filed: Oct. 5, 2018

(65) Prior Publication Data

US 2019/0108782 A1 Apr. 11, 2019

(30) Foreign Application Priority Data

Oct. 11, 2017 (JP) ..... 2017-197716

(51) Int. Cl.
*G09G 3/20* (2006.01)
*G09G 3/36* (2006.01)

(52) U.S. Cl.
CPC ..... *G09G 3/2059* (2013.01); *G09G 3/2022* (2013.01); *G09G 3/2044* (2013.01); *G09G 3/3607* (2013.01); *G09G 3/2077* (2013.01); *G09G 2320/0276* (2013.01)

(58) Field of Classification Search
CPC ..... H04N 1/4052; H04N 1/51; H04N 1/405; H04N 1/4051; H04N 1/4055; H04N 1/32256; G09G 3/2059; G09G 3/2022; G09G 3/2803; G09G 3/2066; G09G 3/2029; G09G 2360/16; G09G 2320/0266
See application file for complete search history.

(56) References Cited

U.S. PATENT DOCUMENTS 5,172,247 A * 12/1992 Ghaderi ..... H04N 1/4053 358/3.03
5,724,058 A * 3/1998 Choi ..... G09G 3/2011 345/89
6,118,905 A * 9/2000 Uehara ..... G09G 3/2059 358/447
2006/0012547 A1* 1/2006 Chang ..... G09G 3/298 345/63
2009/0021506 A1* 1/2009 Kim ..... G09G 3/2944 345/211

FOREIGN PATENT DOCUMENTS

JP 5834921 B2 11/2015
JP 5824921 B2 12/2015

* cited by examiner

*Primary Examiner* — Dong Hui Liang

(74) *Attorney, Agent, or Firm* — Nath, Goldberg & Meyer; Jerald L. Meyer

(57) ABSTRACT

An error diffusion unit generates difference error addition data by adding, to pixel data of a target pixel among pixels in a display element, neighboring error data and difference error data of a pixel processed immediately before, and generates error diffusion data using data on a high-order bit amide of the difference error addition data. The error diffusion unit calculates error data of the target pixel using data on a low-order bit side of the difference error addition data, and calculates difference error data to be added to pixel data of a pixel to be processed subsequently, using a difference between the error data of the target pixel and the error data of the neighboring pixels.

7 Claims, 10 Drawing Sheets

| GRADIENTS | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| 0 | 0 | 0 | 0 | 0 | 0 | 0 | 0 | 0 | 0 | 0 | 0 | 0 |
| 1 | 1 | 0 | 0 | 0 | 0 | 0 | 0 | 0 | 0 | 0 | 0 | 0 |
| 2 | 1 | 1 | 0 | 0 | 0 | 0 | 0 | 0 | 0 | 0 | 0 | 0 |
| 3 | 1 | 1 | 1 | 0 | 0 | 0 | 0 | 0 | 0 | 0 | 0 | 0 |
| 4 | 1 | 1 | 1 | 1 | 0 | 0 | 0 | 0 | 0 | 0 | 0 | 0 |
| 5 | 1 | 1 | 1 | 1 | 1 | 0 | 0 | 0 | 0 | 0 | 0 | 0 |
| 6 | 1 | 1 | 1 | 1 | 1 | 1 | 0 | 0 | 0 | 0 | 0 | 0 |
| 7 | 1 | 1 | 1 | 1 | 1 | 1 | 1 | 0 | 0 | 0 | 0 | 0 |
| 8 | 1 | 1 | 1 | 1 | 1 | 1 | 1 | 1 | 0 | 0 | 0 | 0 |
| 9 | 1 | 1 | 1 | 1 | 1 | 1 | 1 | 1 | 1 | 0 | 0 | 0 |
| 10 | 1 | 1 | 1 | 1 | 1 | 1 | 1 | 1 | 1 | 1 | 0 | 0 |
| 11 | 1 | 1 | 1 | 1 | 1 | 1 | 1 | 1 | 1 | 1 | 1 | 0 |
| 12 | 1 | 1 | 1 | 1 | 1 | 1 | 1 | 1 | 1 | 1 | 1 | 1 |

$$E(x,y)=e(x-1,y-1)*a+e(x,y-1)*b+e(x+1,y-1)*c+e(x-1,y)*d/(a+b+c+d)$$

DRIVING DEVICE FOR DRIVING DISPLAY DEVICE, LIQUID CRYSTAL DISPLAY, AND DRIVING METHOD FOR DRIVING DISPLAY DEVICE

CROSS REFERENCE TO RELATED APPLICATION

This application is based upon and claims the benefit of priority under 35 U.S.C. § 119 from Japanese Patent Application No. 2017-197716, filed on Oct. 11, 2017, the entire contents of which are incorporated herein by reference.

BACKGROUND

The present disclosure relates to a driving device for driving a display device (such as a liquid crystal display (LCD), a plasma display panel (PDP), and digital light processing (DLP)), an LCD, and a driving method for driving a display device, and more particularly, to a driving device for driving a display device which displays an image by dividing a frame into a plurality of sub-frames using a digitized video signal as an input signal, an LCD, and a driving method for driving a display device.

A method for driving a liquid crystal display element used in an LCD is divided into an analog mode and a digital mode. The analog mode uses continuous analog voltage values applied to a pixel. The digital mode controls an effective voltage value using a binary voltage applied to a pixel of a liquid crystal, by varying a time width of the applied voltage depending on the luminance (color gradients) of an image.

Since the digital mode only applies information of "0" or "1" to a pixel, the digital mode is hardly influenced by external factors such as noise. A PDP and DLP are driven in the digital mode because of their display mechanisms.

The digital mode typically uses a sub-field method in order to generate halftone image's. The sub-field method is to display a halftone image using a visual integration effect of a viewer by preparing a predetermined number of sub-fields for one field period of a video signal, and appropriately selecting and displaying a sub-field depending on a gradient of the video signal displayed.

When an LCD employs the sub-field method, different digital values of "1" and "0" are indicated between adjacent pixels, and a lateral electric field is thus generated. The lateral electric field varies luminance between the pixels to cause deterioration of image quality Japanese Patent JP5834921 discloses a method of preventing deterioration of image quality caused by a lateral electric field, using a dithering circuit for gradient generation provided with frame rate control (FRC) at the end of the circuit so as to disperse the lateral electric field.

In association with recent demands for higher color gradients and higher contrast in image display devices, deterioration of image quality derived from a lateral electric field such as a Mach band illusion, which was hardly distinguished, tends to appear in a portion having a smooth and soft gradient, such as a ramp waveform and a sunset image.

SUMMARY

According to a first aspect of the embodiments, there is provided a driving device for driving a display device, including: an error diffusion unit configured to (i) generate difference error addition data by adding neighboring error data and difference error data to pixel data of a target pixel among pixels in a display element, wherein the neighboring error data is error data of neighboring pixels and wherein the difference error data is difference error data of a pixel processed immediately before, and (ii) generate error diffusion data using data on a high-order bit side of the difference error addition data; a frame rate controller configured to generate frame rate control data using the error diffusion data; a sub-frame data generation unit configured to generate sub-frame data using the frame rate control data; and a drive controller configured to drive a plurality of, sub-frames included in a frame using the sub-frame data so as to drive the target pixel in the display element, wherein the error diffusion unit calculates error data of the target pixel using data on a low-order bit side of the difference error addition data, and calculates difference error data to be added to pixel data f a pixel to be processed subsequently, using a difference between the error data of the target pixel and the error data of the neighboring pixels.

According to a second aspect of the embodiments, there is provided a liquid crystal display including: a driving device configured to drive pixels in a liquid crystal display element; an illumination optical system configured to cause illumination light to enter the liquid crystal display element; and a projection lens configured to project modulated light emitted from the liquid crystal display element, the driving device including: an error diffusion unit configured to (i) generate difference error addition data by adding neighboring error data and difference error data to pixel data of a target pixel among the pixels in the liquid crystal display element, wherein the neighboring error data is error data of neighboring pixels and wherein the difference error data is difference error data of a pixel processed immediately before, and (ii) generate error diffusion data using data on a high-order bit side of the difference error addition data; a frame rate controller configured to generate frame rate control data using the error diffusion data; a sub-frame data generation unit configured to generate sub-frame data using the frame rate control data; and a drive controller configured to drive a plurality of sub-frames included in a frame using the sub-frame data so as to drive the target pixel in the liquid crystal display element, wherein the error diffusion unit calculates error data of the target pixel using data on a low-order bit side of the difference error addition data, and calculates difference error data to be added to pixel data of a pixel to be processed subsequently, using a difference between the error data of the target pixel and the error data of the neighboring pixels.

According to a third aspect of the embodiments, there is provided a driving method for driving a display device, including the steps of: generating difference error addition data by adding neighboring error data and difference error data to pixel data of a target pixel among pixels in a display element, wherein the neighboring error data is error data of neighboring pixels and wherein the difference error data is difference error data of a pixel processed immediately before; generating error diffusion data using data on a high-order bit side of the difference error addition data; generating frame rate control data using the error diffusion data; generating sub-frame data using the frame rate control data; and driving a plurality of sub-frames included in a frame using the sub-frame data so as to drive the target pixel in the display element, the step of generating the error diffusion data including: calculating error data of the target pixel using data on a low-order bit side of the difference error addition data; and calculating difference error data to be added to pixel data of a pixel to be processed subsequently, using a difference between the error data of the target pixel and the error data of the neighboring pixels.

DETAILED DESCRIPTION

An embodiment of the present disclosure is described below with reference to the drawings. The present disclosure can be widely used for panel display devices including display panels in which a plurality of pixels is arranged in a matrix form. The present embodiment exemplifies a projection display device including an active matrix-type reflective liquid crystal display element. Schematic configurations of the projection display device and the reflective liquid crystal display element are described below. The present disclosure can be used for not only a liquid crystal display (LCD), but also a panel display device such as a plasma display panel (PDP), digital light processing (DLP), and an organic electroluminescent (EL) display.

(Entire Configuration)

Figure 1:
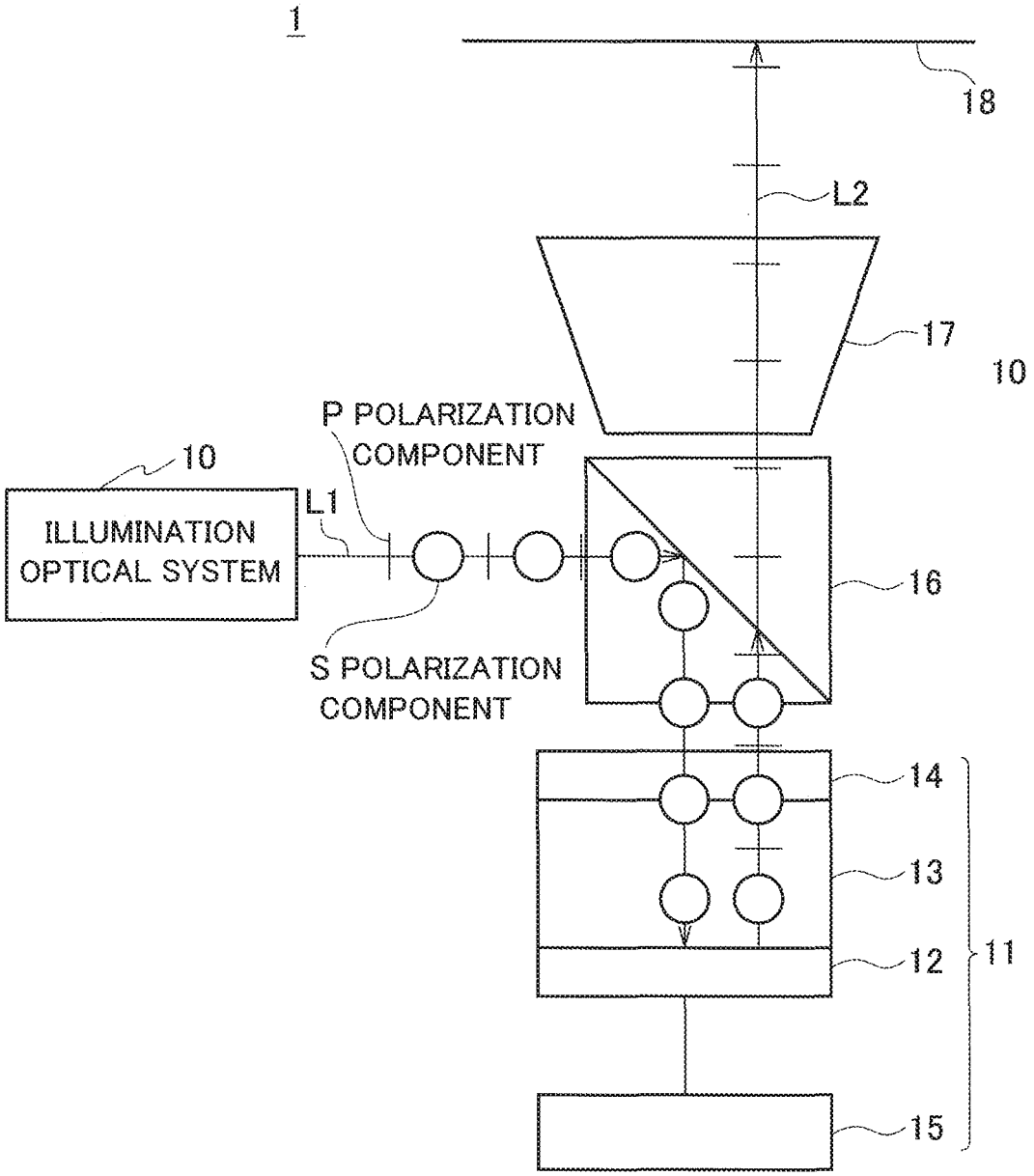
FIG. 1 is a schematic block diagram showing a projection display device using a reflective liquid crystal display element according to an embodiment.

FIG. 1 is a schematic configuration diagram of a projection display device including a reflective liquid crystal display element. The projection display device 1 includes an illumination optical system 10, a liquid crystal display element 11, a polarizing beam splitter (PBS) 16, and a projection lens 17. Light emitted from the projection lens 17 is projected on a screen 18.

The liquid crystal display element 11 includes a plurality of pixel electrodes 12 having electric conductivity and light reflectivity, a liquid crystal layer 13, a counter electrode (a transparent electrode) 14 corresponding to the plural pixel electrodes 12, having electric conductivity and transparency, and a pixel circuit 15. The plural pixel electrodes 12 are arranged in a two-dimensional matrix form on the surface of a first substrate (not shown). FIG. 1 illustrates one of the pixel electrodes 12. The counter electrode 14 is formed on the surface of a second substrate (not shown). The liquid crystal layer 13 is sealed in a space between the first substrate and the second substrate such that the pixel electrodes 12 and the counter electrode 14 are opposite and separated from each other. The respective surfaces of the pixel electrodes 12 and the counter electrode 14 are covered with an orientation film (not shown). The pixel circuit 15 is electrically connected to the pixel electrodes 12.

The projection display device 1, on the PBS 16, receives incident light L1 which is a backlight emitted from the illumination optical system 10. The incident light L1 contains S polarization components and P polarization components with the respective polarized surfaces perpendicular to each other. FIG. 1 schematically indicates the P polarization components by line segments and the S polarization components by circles. The PBS 16 has optical characteristics that reflect the S polarization components and transmit the P polarization components of the incident light. The PBS 16 thus reflects the S polarization components of the incident light L1 so as to be incident on the counter electrode 14.

The liquid crystal display element 11 causes the S polarization components incident on the counter electrode 14 to pass through liquid crystal layer 13 to the pixel electrode 12, so as to be reflected by the pixel electrode 12. The liquid crystal display element 11 emits the reflected light from the pixel electrode 12 through the liquid crystal layer 13 and the counter electrode 14. In the above process in which the S polarization components incident on the counter electrode 14 are reflected by the pixel electrode 12 and emitted from the counter electrode 14, the liquid crystal display element 11 modulates the S polarization components incident on the counter electrode 14 in accordance with a potential difference between a driving voltage corresponding to pixel data applied to the pixel electrodes 12 and a common voltage applied to the counter electrode 14, and uses part of the S polarization components as the P polarization components as to emit light containing the S polarization components and the P polarization components.

The PBS 16 transmits and passes the P polarization components of the light emitted from the liquid crystal display element 11 to the projection lens 17. The PBS 16 reflects and passes the S polarization components of the light emitted from the liquid crystal display element 11 to the illumination optical system 10. The projection lens 17 projects the P polarization components transmitted from the PBS 16 as emission light L2 on the screen 18 so as to display an image. The phrase "intensity of output light" described below refers to the luminance of the emission light L2 measured on the screen 18.

(Pixel Configuration)

Figure 2:
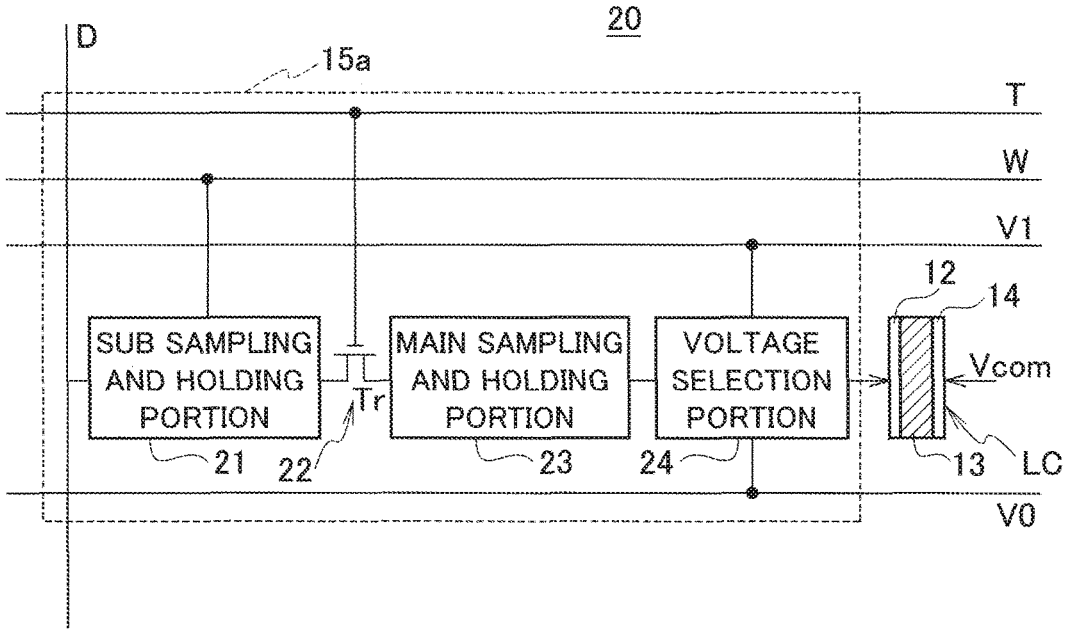
FIG. 2 is a configuration diagram of one of the pixels in the liquid crystal display element.

FIG. 2 is a configuration diagram showing a pixel 20 in the liquid crystal display element 11. The pixel 20 in the liquid crystal display element 11 shown in FIG. 2 includes a pixel circuit 15*a* and a liquid crystal element LC, and is located at an intersection between a column data line D and a row selection line W. In the liquid crystal element LC, the liquid crystal layer 13 is sealed in the space between the first substrate and the second substrate such that the pixel electrodes 12 and the counter electrode 14 are opposite and separated from each other, as described above.

The pixel circuit 15*a* is an example of the pixel circuit 15. As shown in FIG. 2, the pixel circuit 15*a* includes a sub sampling and holding portion 21, a transfer switching transistor 22, a main sampling and holding portion 23, and a voltage selection portion 24. The sub sampling and holding portion 21 and the main sampling and holding portion 23 each include a flip-flop of a static random-access memory (SRAM) structure. The sub sampling and holding portion 21 is connected to the column data line D and the row selection line W. When the sub sampling and holding portion 21 is selected according to a row selection signal applied through the row selection line W, the sub sampling and holding portion 21 samples and holds pixel data supplied through the column data line D.

The transfer switching transistor 22 is connected at a source to an output terminal of the sub sampling and holding portion 21, connected at a drain to an input terminal of the main sampling and holding portion 23, and connected at a gate to a transfer signal line T. When a transfer signal with a predetermined logical value is applied through the transfer signal line T, the transfer switching transistor 22 is activated to transfer sub-frame data (a pixel data voltage) held in the sub sampling and holding portion 21 to the main sampling and holding portion 23.

The main sampling and holding portion 23 samples and holds the sub-frame data (the pixel data voltage) input through the transfer switching transistor 22. The voltage selection portion 24 is connected to a blanking voltage line V0 and a driving voltage line V1. An output terminal of the voltage selection portion 24 is connected to the pixel electrode 12. The voltage selection portion 24 selects one of a blanking voltage in the blanking voltage line V0 and a driving voltage in the driving voltage line V1 in accordance with a value (0 or 1) of the sub-frame data (the pixel data voltage) held in the main sampling and holding portion 23, so as to apply the selected voltage to the pixel electrode 12. A voltage applied to the counter electrode 14 is called a common voltage Vcom.

The sub sampling and holding portion 21 receives and holds sub-frame data corresponding to predetermined sub-frame in a data transfer period of the predetermined sub-frame. The sub sampling and holding portion 21 transfers the sub-frame data corresponding to the predetermined sub-frame to the main sampling and holding portion 23 after a lapse of the data transfer period of the predetermined sub-frame. The sub sampling and holding portion 21 then drives the predetermined sub-frame using the sub-frame data held in the main sampling and holding portion 23 in a data transfer period of a subsequent sub-frame next to the predetermined sub-frame. Accordingly, the transfer of the data and the drive of the sub-frame can efficiently be executed simultaneously.

Figure 3:
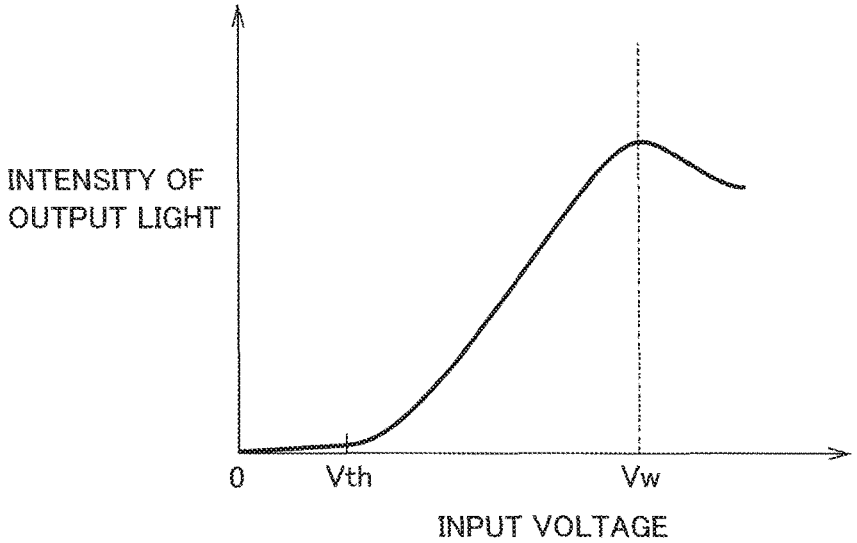
FIG. 3 is a graph showing a relationship between an input voltage and intensity of output light in the liquid crystal display element.

FIG. 3 is a graph showing a relationship between an input voltage and the intensity of output light in the liquid crystal display element 11. A horizontal axis in FIG. 3 represents the input voltage, which is a potential difference between the pixel electrodes 12 and the counter electrode 14, namely, a driving voltage of the liquid crystal layer 13. A vertical axis in FIG. 3 represents the intensity (luminance) of output light emitted from the liquid crystal layer 13.

When the voltage is zero, in particular, when the pixel electrodes 12 and the counter electrode are both ground (GND), for example, the intensity of the input light is small, which is a black state (a blanking voltage). A voltage at which the output light starts saturation is a saturation voltage Vw (a white level).

(Driving Device and Driving Method)

Figure 4:
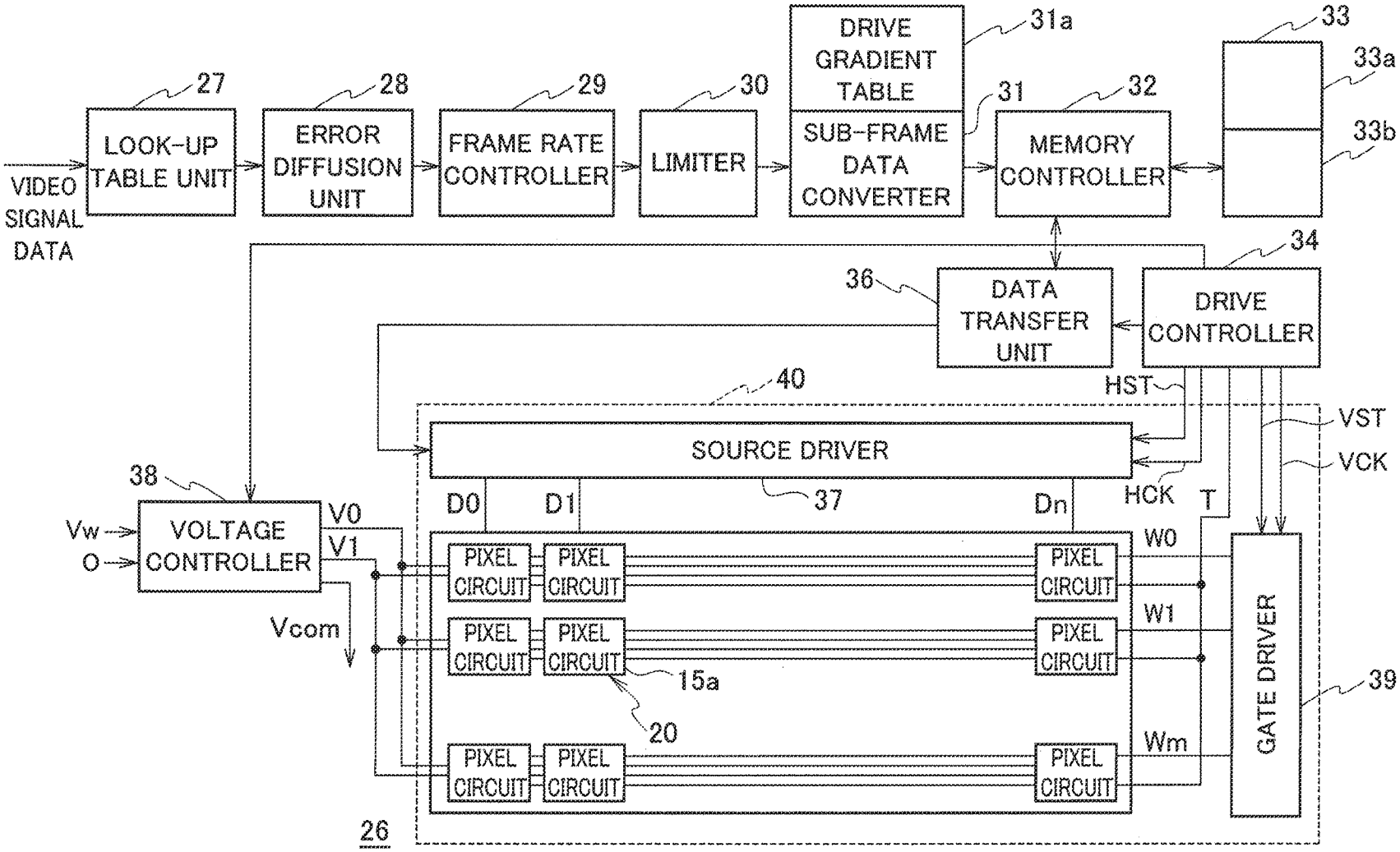
FIG. 4 is a block diagram showing a driving circuit configuration of a liquid crystal display.
Figure 5:
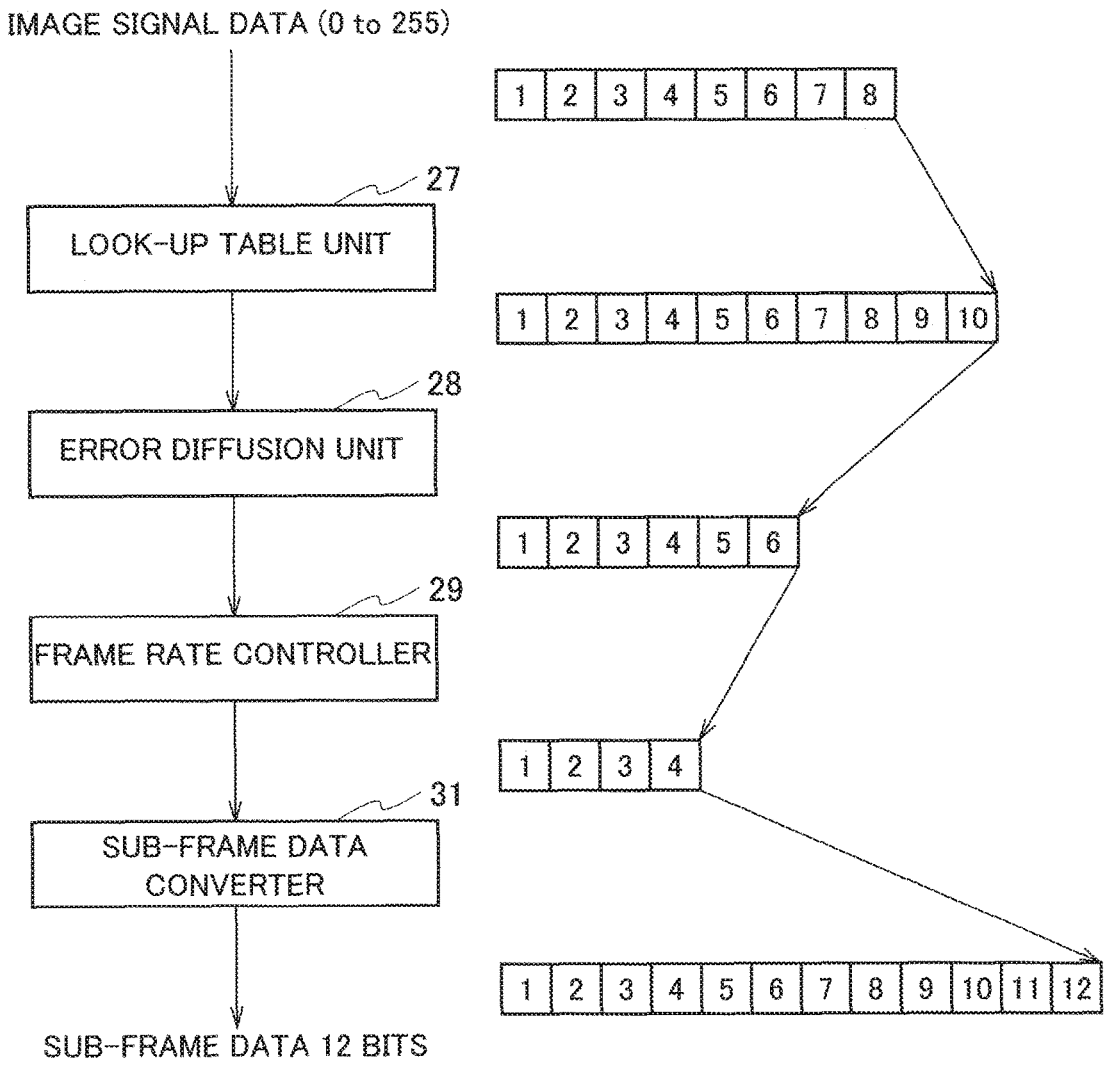
FIG. 5 is an explanatory diagram of signals in each unit shown in FIG. 4.
Figure 6:
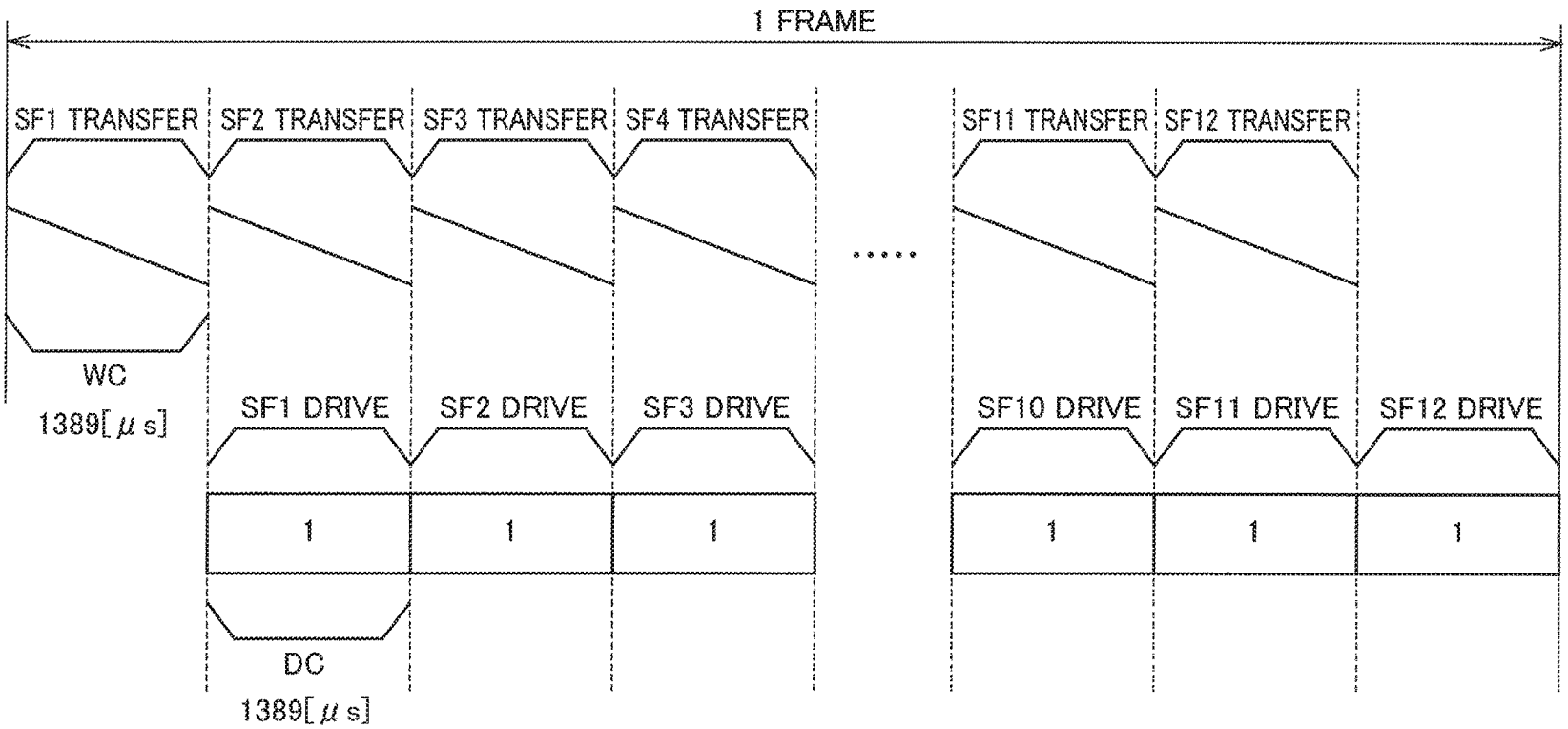
FIG. 6 is an explanatory diagram showing an example of a driving pattern of the liquid crystal display element.
Figures 7, 8:
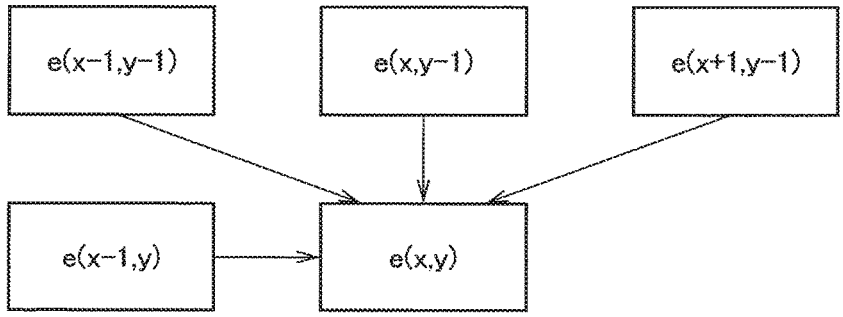
FIG. 7 is a diagram showing an example of a drive gradient table.
FIG. 8 is a diagram showing error diffusion from adjacent pixels.
Figure 9:
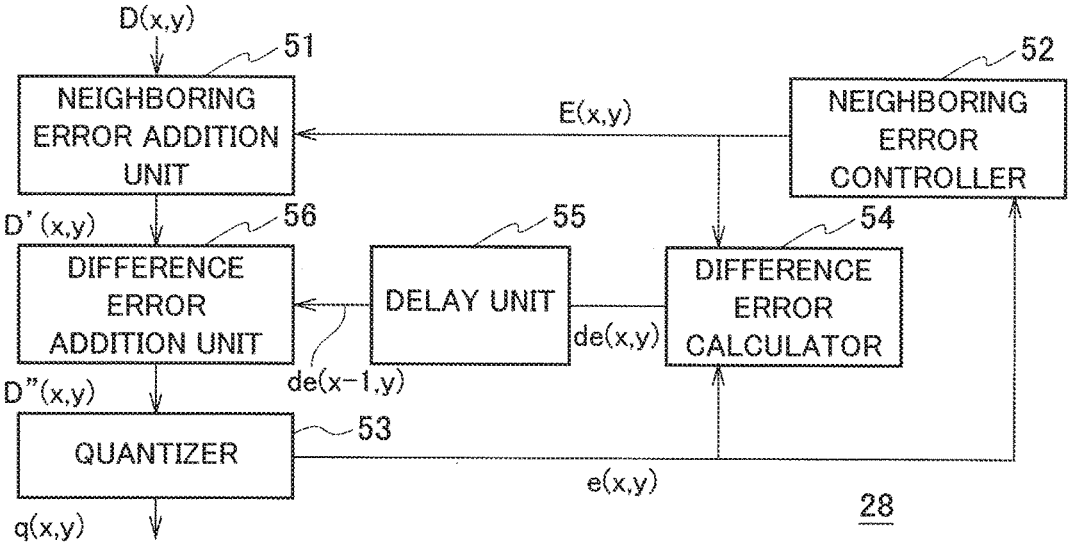
FIG. 9 is a diagram showing processing of an error diffusion unit.

A driving device and a driving method for the display element according to the present embodiment are described below with reference to FIG. 4 to FIG. 9. FIG. 4 is a block diagram showing a liquid crystal display panel 26 including a driving device. FIG. 5 is a diagram illustrating a gradient expression in each unit when the number of bits of input video signal data is set to eight. The gradient expression of an error diffusion portion 28 in FIG. 5 does not indicate a carry bit value of "1". FIG. 6 is a diagram showing a driving pattern of the display element FIG. 7 is a diagram showing a drive gradient table. FIG. 8 is a diagram showing error diffusion from adjacent pixels. FIG. 9 is a diagram showing processing of the error diffusion unit 28. The present embodiment uses a dithering circuit for gradient generation to diffuse error data of peripheral pixels, and disperse a lateral electric field using a frame rate control circuit.

The liquid crystal display panel 26 includes a processor and a memory as hardware. As shown in FIG. 4, the liquid crystal display panel 26 includes a look-up table unit 27, the error diffusion unit 28, a frame rate controller 29, a limiter 30, a sub-frame data converter 31, a memory controller 32, a frame buffer 33, a drive controller 34, a data transfer unit 36, a source driver 37, a voltage controller 38, a gate driver 39, and a pixel unit 40.

The pixel unit 40 includes pixels 20 having the number of (n+1)×(m+1) arranged at intersections between column data lines D0 to Dn having the number of n+1 and row selection lines W0 to Wm having the number of m+1. Each pixel 20 has the same configuration as the pixel 20 shown in FIG. 2. As shown in FIG. 2, each of the voltage selection portions 24 of all of the pixels 20 in the pixel unit 40 is commonly connected to the blanking voltage line V0 and the driving voltage line V1, and each of the transfer switching transistors 22 of all of the pixels 20 is commonly connected to the transfer signal line T.

Video signal data of N bits is input to the look-up table unit 27. The look-up table unit 27 includes a look-up table (LUT). The look-up table unit 27 executes inverse-gamma correction with reference to the LUT. The video signal data of N bits is thus converted to pixel data of (M+F+D) bits greater than N bits. As used herein, M refers to the number of hits when the number of sub-frames is represented by the binary number, D refers to the number of bits interpolated by the error diffusion unit 28, and F refers to the number of bits interpolated by the frame rate controller 29. Each of N, M, D, and F is a positive integer.

FIG. 5 exemplifies the case in which the number of bits of the input video signal data is eight (N=8), the number of bits interpolated by the error diffusion unit 28 is four (D=4), and the number of bits interpolated by the frame rate controller 29 is two (F=2). The number of bits when the number of sub-frames is represented by the binary number is four (M=4), and the drive gradients are 12 (without including black).

The operation of the look-up table unit 27 is described below. Video signals are typically subjected to gamma correction. The display device needs to execute inverse-gamma correction to a video signal having been subjected to gamma correction so as to return the video signal to a linear gradient. The inverse-gamma correction is to correct an output to raise an input X to the power of 2.2. Hereinafter, such an output property is called "gamma 2.2".

The look-up table unit 27 converts input-output properties of the liquid crystal display element 11 so as to implement the liquid display device having the output property of gamma 2.2. The look-up table is preliminarily set such that an output of 10 bits has a predetermined output property (for example, gamma 2.2). For example, an image obtained by the drive of the respective 12 drive gradients (without including black) shown in FIG. 7 is projected by the liquid crystal display shown in FIG. 1, and the luminance on the screen 18 is preliminarily measured with an illuminometer. The luminance between the respective drive gradients are subjected to linear interpolation with six bits (D=4 and F=2)

(64 gradients), so as to predict luminance data of each of zero to 763 gradients. The look-up table preliminarily stores 256 pieces of data having a predetermined output property (for example, gamma 2.2) selected from the luminance data.

The look-up table unit 27 has a look-up table having 256 gradients×10 bits, namely, [(2 to the 8th power) gradients×(4+4+2) bits]. As used herein, the expression "[(2 to the 8th power) gradients×(4+4+2) bits]" corresponds to [(2 to the Nth power) gradients×(M+D+F) bits] in which N=8, M=4, D=4, and F=2 are substituted. The look-up table unit 27 converts the input image data of eight bits to unsigned data of 10 bits and outputs the data.

Returning to FIG. 4, the video signal data converted to (M+D+F) bits by the look-up table unit 27 is converted to data of (M+F+1) bits such that the information of the low-order D bits is diffused to neighboring pixels by the error diffusion unit 28. FIG. 5 exemplifies the case in which the converted data of 10 bits is quantized to data of high-order six bits such that the information of the low-order four bits is diffused to neighboring pixels by the error diffusion unit 28, so as to output as data of seven bits to which a carry bit value of "1" is added.

The error diffusion method is dithering to cancel out gradient deficiency by diffusing, to neighboring pixels, a quantization error of a pixel subjected to quantization. In other words, the error diffusion method is to add errors of neighboring pixels (quantization errors) to a value of a pixel before quantization, and then to subject the pixel to quantization so as to cancel out gradient deficiency. The present embodiment not only diffuses, to neighboring pixels, a quantization error of a pixel subjected to quantization but also adds, to subsequent pixel data to be processed, difference error data obtained by subtracting neighboring error data from the quantization error.

The operation of the error diffusion unit 28 is described in detail below with reference to FIG. 9. As shown in FIG. 9, the error diffusion unit 28 includes a neighboring error addition unit 51, a neighboring error controller 52, a quantizer 53, difference error calculator 54, a delay unit 55, and a difference error addition unit 56.

In the following explanations, image data is processed from an upper line to a lower line of the screen, and from the left side to the right side of the screen. A pixel to be processed (a target pixel) has the coordinates of (x, y). The x-coordinate increases by one per pixel from the left side to the right side, and the y-coordinate increases by one per pixel from the upper side to the lower side.

The neighboring error addition unit 51 adds signed neighboring error data E (x, y) of six bits to unsigned image data D (x, y) of 10 bits. The neighboring error addition unit 51 outputs unsigned neighboring error addition data D' (x, y) of 11 bits obtained by adding a carry bit value of "1" to the unsigned image data D (x, y) of 10 bits. When the result of the addition is a negative number, the most significant (sign) bit is to be "0".

The difference error addition unit 56 adds signed difference error data de (x−1, y) of seven bits to the unsigned neighboring error addition data D' (x, y) of 11 bits. The difference error addition unit 56 outputs unsigned difference error addition data D" (x, y) of 11 bits. When the result of the addition is a negative number, the most significant (sign) bit is to be "0".

The quantizer 53 divides the difference error addition data D" (x, y) of 11 bits into high-order seven bits and low-order four bits. The low-order four bits are not converted, but used as signed error data e (x, y) of four bits. When the most significant (sign) bit of the signed error data e (x, y) of four bits is "1", the number of "1" is added to data of the high-order seven bits of the difference error addition data D" (x, y), so as to be output as unsigned error diffusion data q (x, y) of seven bits from the error diffusion unit 28. When the most significant (sign) bit of the signed error data e (x, y) of four bits is "0", the data of the high-order seven bits of the difference error addition data. D" (x, y) is directly output as unsigned error diffusion data q (x, y) of seven bits the error diffusion unit 28. The error data e (x, y) output from the quantizer 53 is input to the difference error calculator 54 and the neighboring error controller 52.

While the present embodiment exemplifies the case in which the number of "1" is added to the high-order seven bits of the difference error addition data D" (x, y) in accordance with the value of the most significant bit of the error data e (x, y), the number of "1" may be added to the high-order seven bits of the difference error addition data D" (x, y) in accordance with a result of comparison between the error data e (x, y) and a predetermined threshold. For example, when the error data e (x, y) is greater than the predetermined threshold, the number of "1" is added to the high-order seven bits of the difference error addition data D" (x, y). When the error data e (x, y) is not greater than the predetermined threshold, the number of "1" is not added to the high-order seven bits of the difference error addition data D" (x, y). The quantizer 53 thus determines whether the number of "1" is added to the high-order seven hits of the difference error addition data D" (x, y) depending on the result of comparison between the error data e (x, y) and the predetermined threshold.

The neighboring error controller 52 stores the error data e (x, y) generated at the time of quantization as error data per pixel including pixel positional information. As shown in FIG. 8, the neighboring error controller 52 reads out error data e (x−1, y−1) of a pixel located on the upper left side of a target pixel, error data e (x, y−1) of a pixel located immediately above the target pixel, error data e (x+1, y−1) of a pixel located on the upper right side of the target pixel, and error data e (x−1, y) of a pixel located on the left side of the target pixel. The neighboring error controller 52 calculates a neighboring error signal E (x, y) which is a weighted average of the values of the read error data according to the following equation (1):

$$E(x,y)=[e(x-1,y-1)\times a+e(x,y-1)\times b+e(x+1,y-1)\times c+e(x-1,y)\times d]/(a+b+c+d) \quad (1)$$

where a, b, c, and d are predetermined coefficients. The use of the weighted average of the quantization error data of the plural neighboring pixels can diffuse the error appropriately. The neighboring error signal E is not necessarily the weighted average, but may be simply an arithmetic mean. Namely, the coefficients a, b, c, and d may each be set to "1".

The neighboring error signal E (x, y) output from the neighboring error controller 52 is input to the neighboring error addition unit 51 to be added to the image data D (x, y), and is also input to the difference error calculator 54. The difference error calculator 54 calculates a difference between the error signal e (x, y) and the neighboring error signal E (x, y), and outputs a difference error signal de (x, y) to be added to subsequent pixel data to be processed. The delay unit 55 delays the difference error data de (x, y) for a time required for single pixel processing so as to transfer the data to the difference error addition unit 56.

As described above, the error diffusion unit 28 not only diffuses, to the neighboring pixels, the error data e (x, y) of the pixel subjected to quantization, but also adds the difference error data de (x, y) obtained by subtracting the neighboring error data E (x, y) from the error data e (x, y) to the subsequent pixel data to be processed. The error diffusion method of the present embodiment thus can add unevenness (noise) to error diffusion without great change in design of the circuit, as compared with a method of only diffusing error data e (x, y) of a pixel subjected to quantization to neighboring pixels. The addition of unevenness (noise) can enhance dispersion of a lateral electric field by frame rate control performed at a later stage, so as to further prevent deterioration of image quality derived from the lateral electric field. The prevention of deterioration of image quality derived from the lateral electric field hardly appears at a part in an image having a smooth and soft gradient.

Figure 13:
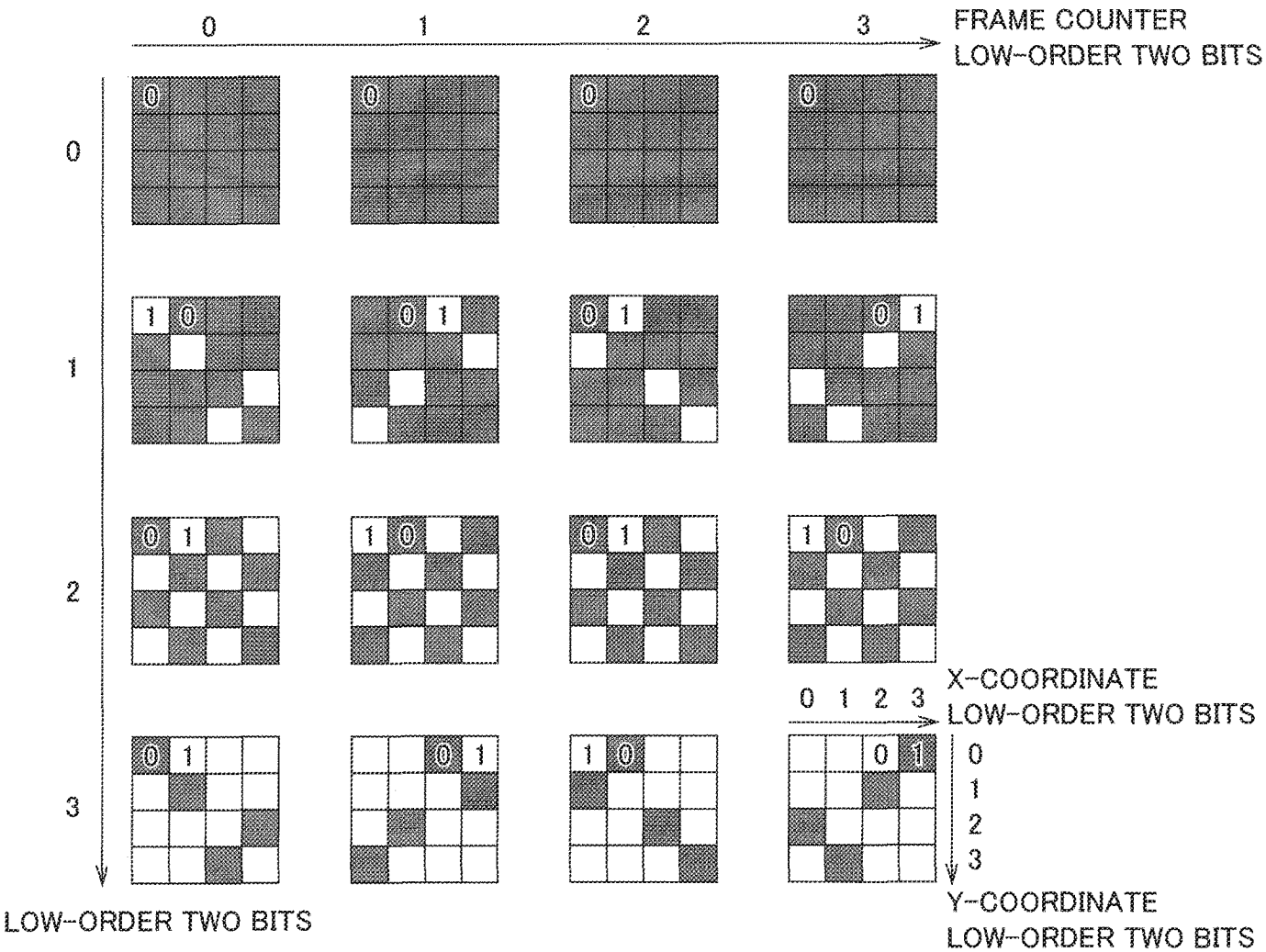
FIG. 13 is a diagram showing a table of frame rate control.

Returning to FIG. 4 and FIG. 5, the unsigned error diffusion data q (x, y) of seven bits output from the error diffusion unit 28 is input to the frame rate controller 29. FIG. 13 illustrates a table of the frame rate controller 29. The frame rate controller 29 uses the low-order two bits of the error diffusion data q (x, y), the low-order two bits of the x-coordinate data on the screen, the low-order two bits of the y-coordinate data on the screen, and the low-order two bits of the frame counter value while referring to the table shown in FIG. 13, and adds "1" to the high-order five bits of the error diffusion data q (x, y) when the value in the table is "1", so as to input the added value to the limiter 30. The limiter 30 limits the error diffusion data q (x, y) to 12 which is the maximum value of the drive gradients, so as to output the limited data to the sub-frame data converter 31. Namely, the limiter 30 outputs the data of four bits to the sub-frame data converter 31. The sub-frame data converter 31 converts the data of four bits to sub-frame data of 12 gradients. The sub-frame data converter 31 uses a drive gradient table 31*a* to execute the conversion to the 12-bit sub-frame data.

FIG. 7 illustrates the drive gradient table 31*a*. The sub-frames are composed of step-bit pulses. When sub-frame data is "1", the sub-frame is in a driving state. When the sub-frame data is "0", the sub-frame is in a blanking state. As the drive gradient is increased by one, the number of the sub-frames in the driving state is increased by one toward the front or the rear of the sub-frame already in the driving state. The drive gradient table 31*a* thus shows the continuous sub-frames in the driving state. A sub-frame turning to the driving state when the drive gradient (the sub-frame data) is "1" is preferably the first sub-frame (SF1) or the last sub-frame (SF12). The drive gradient table 31*a* shown in FIG. 7 only needs to increase the number of the sub-frames turning to the driving state by one as the driving period proceeds by one. The positions of the sub-frames turning to the driving state are optional. The driving period of each sub-frame does not need to be common to each other, and it is optional.

Returning to FIG. 4, the 12-bit sub-frame data output from the sub-frame data converter 31 is stored via the memory controller 32 in the frame buffer 33 divided for each sub-frame. The frame buffer 33 has a double-buffer structure including a first frame buffer 33*a* and a second frame buffer 33*b*. When data is stored in the first frame buffer 33*a*, data in the second frame buffer 33*b* is transferred to the pixel circuit via the data transfer unit 36. The data stored in the first frame buffer 33*a* during the previous frame period is then transferred to the pixel circuit via the data transfer unit 36 in the subsequent frame period, while the input video signal data output from the sub-frame converter 31 is stored in the second frame buffer 33*b*.

The drive controller 34 controls the processing timing in each sub-frame in accordance with a horizontal start signal HST and a horizontal clock signal HCK, provides the transfer instructions to the data transfer unit 36, and controls the gate driver 39. The data transfer unit 36 follows the instructions from the drive controller 34 to cause the memory controller 32 to send specified sub-frame data to the data transfer unit 36 so as to transfer the data to the source driver 37. Every time the source driver 37 receives the data for one line from the data transfer unit 36, the source driver 37 simultaneously transfers the data to the corresponding pixel circuits 15*a* in the liquid crystal display element 11 through the corresponding column data lines D0 to Dn.

The gate driver 39 then activates a row selection line Wy of a row designated in accordance with a vertical start signal VST and a vertical shift clock signal VCK from the drive controller 34, so as to transfer the data to pixels of all of columns common to the designated row y. Each of the pixels 20 is connected to the transfer signal line T. As shown in FIG. 2, the transfer signal line T is connected with the transfer switching transistors 22 of the pixel circuits 15*a* of all of the pixels 20. The drive controller 34 digitally drives the sub-frames using the sub-frame data so as to drive the pixels 20.

A driving pattern is described below with reference to FIG. 6. FIG. 6 illustrates a case in which a video signal includes 60 frames per second, and the number of sub-frames is 12. In FIG. 6, WC represents a data transfer period (a WC period) for transferring data per sub-frame to all of the pixels 20 in the liquid crystal display element 11, and DC represents a driving period (a DC period) for driving a liquid crystal. The WC period is set to 1389 [μs] (=1/(60×12)) and the DC period to 1389 [μs]. The data transfer of SF1 (the WC period) is first executed in one frame, so that the transferred data is stored in the sub sampling and holding portion. 21 in the pixel circuit 15*a*. When the data transfer to every pixel 20 is completed, the transfer signal T turns to high, and the data held in the respective sub sampling and holding portions 21 of all of the pixels 20 is transferred to the respective main sampling and holding portions 23. Subsequently, the data transfer of SF2 (the WC period) is executed, and the drive of SF1 (the DC period) is also executed in the same period as the WC period.

The WC period and the DC period each continue 12 times in parallel, while the DC period starts after a delay of the WC period. The data (0 or 1) assigned to SF1, SF2, . . . , SF11, and SF12 is sequentially transferred in each WC period, and the liquid crystal of every pixel 20 is driven in each DC period. When the data sampled and held in a pixel 20 is "0", the pixel 20 is in the blanking state. When the data sampled and held in the pixel 20 "1", the pixel 20 is in the driving state.

The present embodiment illustrates the projection display device including, as a display element, the active matrix-type liquid crystal display element 11, as described above. The following are explanations of a case of driving a liquid crystal using the drive gradient table shown in FIG. 7. When the gradient is presumed to be K in FIG. 7, the data from SF1 to SFK is "1" (the driving state). Since the data of "1" from SF1 to SFK is considered to indicate a substantially continuous ON state, a relationship between K (the gradient number) and output light delineates a curve similar to the relationship between the input voltage and the intensity of the output light in the liquid crystal element 11 as shown in FIG. 3. This relationship effective for the operation of the look-up table unit 27. In particular, the relationship between the input voltage and the intensity of the output light in the liquid crystal element 11 delineates a curve relatively close to a curve of gamma 2.2 which the look-up table unit 27 aims, so as to reduce a workload of the look-up unit 27 upon approximating to the curve of gamma 2.2. A transmissive liquid display element can also have the same effect.

Figure 10:
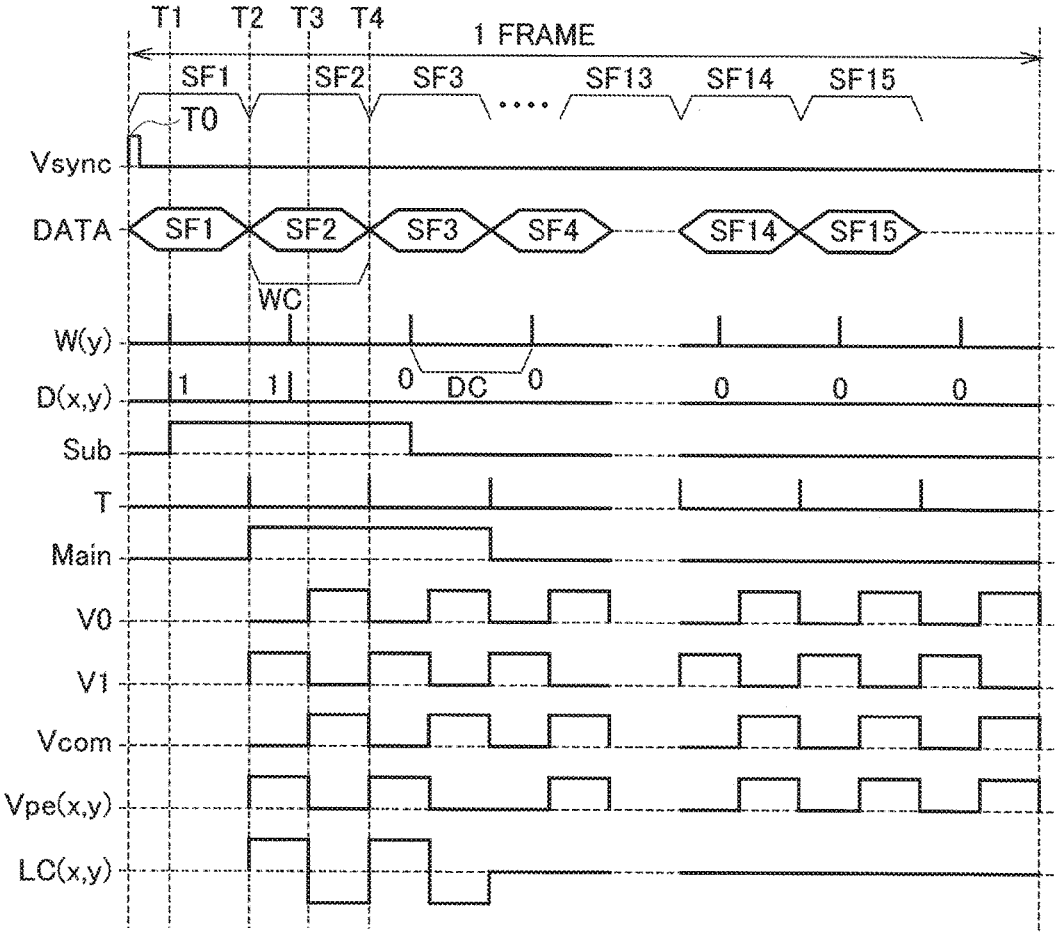
FIG. 10 is a timing chart showing signal processing.
Figure 11:
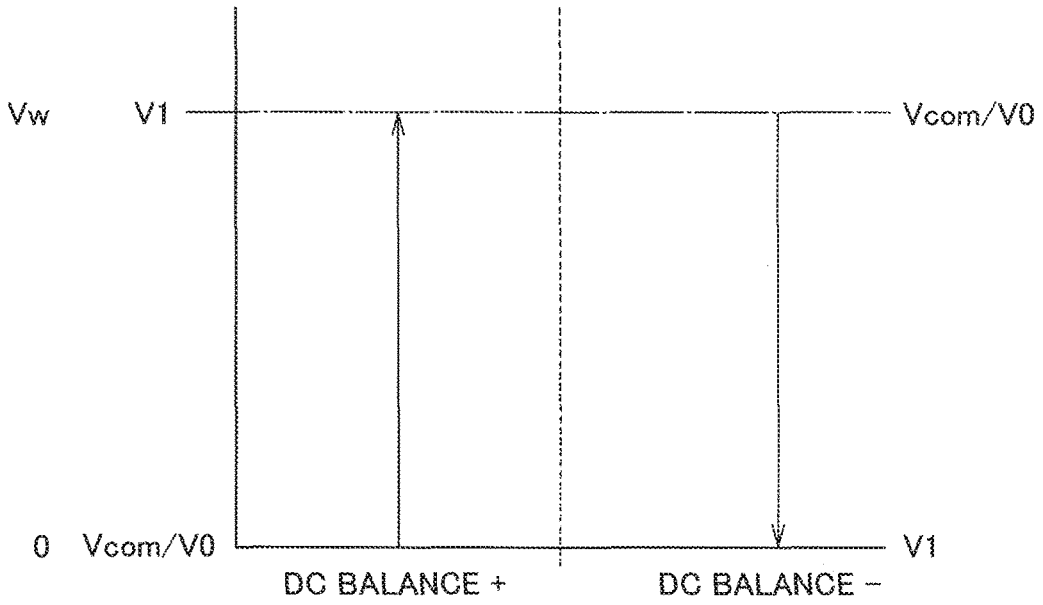
FIG. 11 is a view showing reverse polarity driving of the liquid crystal display element.

FIG. 10 is a timing chart illustrating signal processing. FIG. 11 is a graph indicating reverse polarity driving the liquid crystal display element 11. The signal processing is described below with reference to FIG. 10, in addition to FIG. 2, FIG. 4, and FIG. 6. In FIG. 10, a vertical synchronous signal Vsync is activated at the time T0, and data of the sub-frame 1 (SF1) is first transferred to the liquid crystal display element 11 during a period from the time T0 to the time T2. The period from the time T0 to the time T2 corresponds to the transfer period WC. The data is transferred to a particular pixel (x, y) at the time T1 and is held in the sub sampling and holding portion 21. The transfer signal T turns to high at the time T2, and the data held in the respective sub sampling and holding portions 21 of all of the pixels 20 is transferred to the respective main sampling and holding portions 23. Subsequently, data of the subsequent sub-frame 2 (SF2) is transferred to the liquid crystal display element 11 during a period from the time T2 to the time T4. The period from the time T2 to the time T4 corresponds to the driving period DC of the sub-frame 1 (SF1), in which "DC balance +" driving is executed during the period from the time T2 to the time T3, and "DC balance −" driving is executed during the period from the time T3 to the time T4. The voltage controller 38 controls a voltage value such that V0 and Vcom are GND and V1 is Vw during the period from the time T2 to the time T3, and such that V1 is GND and V0 and Vcom are Vw during the period from the time T3 to the time T4.

When the value of the main sampling and holding part 23 in the pixel circuit 15*a* is "0", V0 is applied to the pixel electrodes 12 through the voltage selection portion 24 in the pixel circuit 15*a*. A pixel electrode voltage Vpe and a counter electrode voltage Vcom are both GND during the period from the time T2 to the time T3. A voltage applied to the liquid crystal layer 13 is zero [v] which leads the driving condition of the liquid crystal to the blanking state.

When the value of the main sampling and holding part 23 in the pixel 20 is "1", V1 is applied to the pixel electrodes 12 through the voltage selection portion 24 in the pixel circuit 15*a*. The pixel electrode voltage Vpe is Vw and the counter electrode voltage Vcom is GND during the period from the time T2 to the time T3. The voltage applied to the liquid crystal layer 13 is +Vw (counter electrode voltage reference), which leads the liquid crystal to the driving state. The pixel electrode voltage Vpe is GND and the counter electrode voltage Vcom is Vw during the period from the time T3 to the time T4. The voltage applied to the liquid crystal layer 13 is −Vw (counter electrode voltage reference), which leads the liquid crystal to the driving state.

By applying the voltages (+Vw, −Vw) having the same value but different polarities to the liquid crystal during the same period, the voltages applied to the liquid crystal are set to +Vw+(−Vw)=0 [v] on average for a long period of time, so as to prevent burn of the liquid crystal. The respective sub-frames from SF2 to SF12 are also subjected to voltage control as in the period from the time T2 to the time T4 of SF1. FIG. 11 illustrates c state corresponding to the period from the time T2 to the time T3 shown in FIG. 10, that is, a state in which V1 is Vw and V0 and Vcom are GND, which is denoted by "DC balance +", and FIG. 11 illustrates a state corresponding to the period from the time T3 to the time T4 shown in FIG. 10, that is, a state in which V1 is GND and V0 and Vcom are Vw, which is denoted by "DC balance −".

Figure 12:
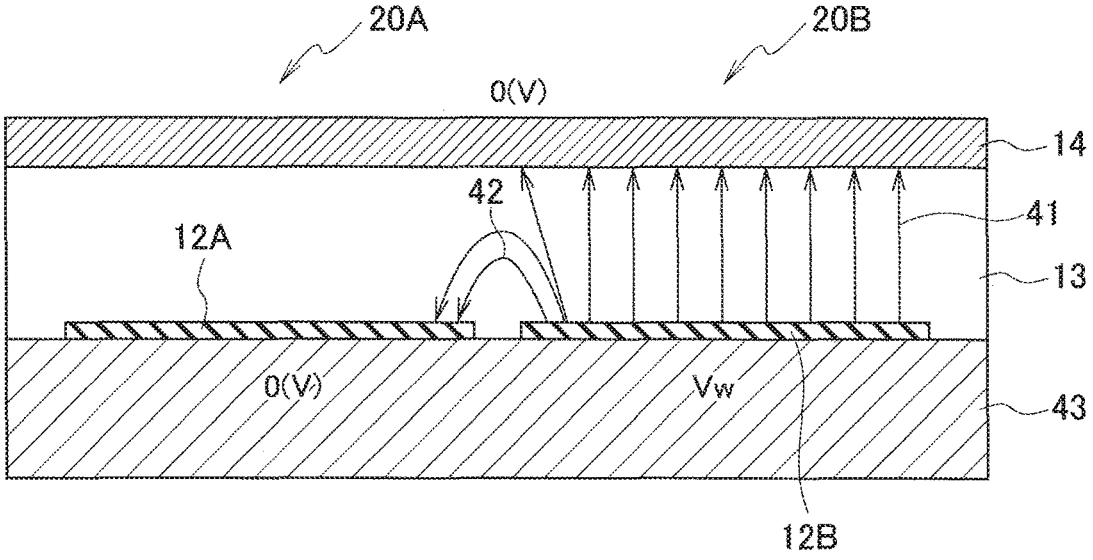
FIG. 12 is an explanatory diagram showing a mechanism of a lateral electric field generated in the liquid crystal display element.

FIG. 12 is a diagram showing a mechanism of lateral electric field generated in the reflective liquid crystal element. FIG. 12 schematically illustrates configurations of pixels 20A and 20B adjacent to each other. As shown in FIG. 12, pixel electrodes 12A and 12B of the reflective liquid crystal element are formed on a silicon substrate 43.

During digital driving, the driving state (driving/blanking) frequently varies between adjacent pixels. The following is an example that the gradients of the pixels 20A and 20B adjacent to each other in a particular frame are presumed to be "5" and "6", and the counter electrode 14 is presumed to be at V0 in the state of "DC balance +". As shown in FIG. 11, the state of "DC balance +" leads to V0=Vcom=0 (V) and V1=Vw. In the period of the sub-frame 6 (SF6), the driving state differs between the adjacent pixels. As shown in FIG. 7, the pixel 20A is in the blanking state, so that the voltage of V0 is applied to the pixel electrode 12A, while the pixel 20B is in the driving state, so that the voltage of V1 is applied to the pixel electrode 12B.

FIG. 12 shows a state of an electric field 41 of the liquid crystal layer 13 when the voltage of V0 is applied to the pixel electrode 12A and the voltage of V1 is applied to the pixel electrode 12B. A potential difference is generated between the pixel electrode 12B (potential: Vw) of the pixel 20B and the counter electrode 14 (potential: 0 (V)), and the liquid crystal is thus rotated by a predetermined amount. At the same time, a potential difference is also generated between the pixel electrode 12A (potential: 0 (V)) of the pixel 20A and the pixel electrode 12B (potential: Vw) of the pixel 20B, and an electric field is thus generated in the lateral direction. Such a lateral electric field 42 causes unintended confusion as to the movement of the liquid crystal between the pixels. This phenomenon leads to deterioration of image quality.

Figure 14:
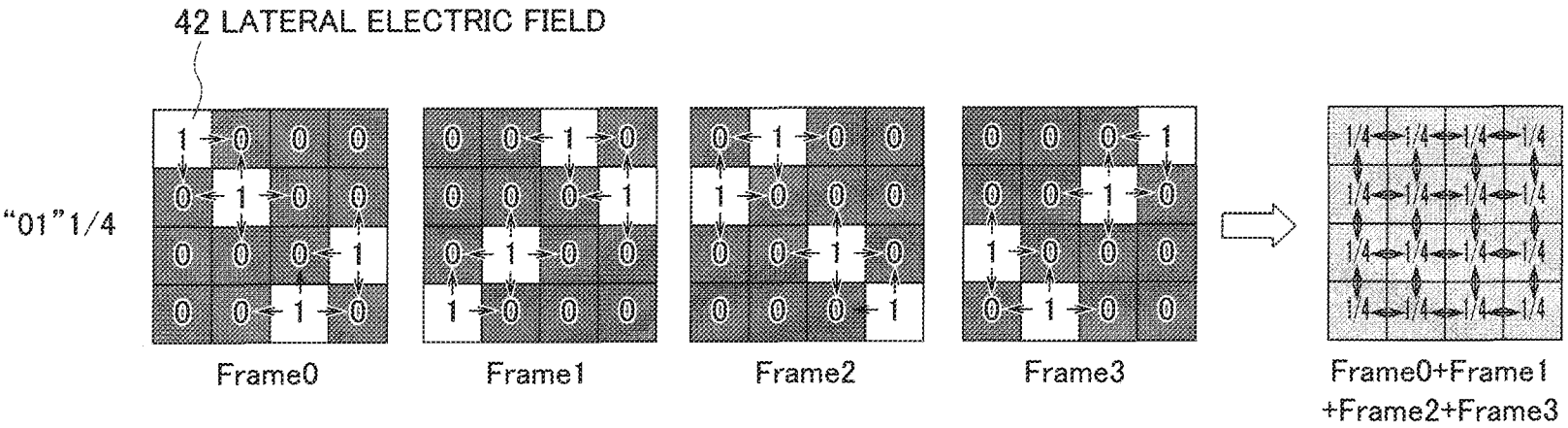
FIG. 14 is an explanatory diagram showing dispersion of the lateral electric field by the frame rate control.

The use of the frame rate control can solve the above-described problem. FIG. 14 is a diagram illustrating uniform dispersion of a lateral electric field due to the frame rate control.

FIG. 14 illustrates a case in which a value of low-order F bits of data ((M+F+1) bits) input to the frame rate controller 29 is "01". Four tables (frames 0 to 3) are used in each frame. When the driving state (driving or blanking) differs between adjacent pixels in each frame, a lateral electric field is generated in a direction from a pixel of which the driving state is "1" (the driving state) to a pixel of which the driving state is "0" (the blanking state). The direction of the lateral electric field between the pixels is indicated by the arrows in FIG. 14. A state in which the lateral electric fields in the four frames are superimposed is shown on the rightmost side. The lateral electric fields between all of the pixels are thus canceled out when the four frames are averaged. The use of the frame rate control thus can cancel out such a lateral electric field which causes deterioration of image quality.

In the conventional technology, a lateral electric field can be dispersed uniformly when a screen has a flat gradient, but cannot be dispersed uniformly when a difference in gradient is caused between pixels. As a result, deterioration of image quality derived from the lateral electric field tends to be obvious. In contrast, the present embodiment provides the error diffusion unit 28 in front of the frame rate controller 29 to add unevenness (noise) to error diffusion, so that the frame rate controller 29 can diffuse the error effectively with simple change in configuration.

The present embodiment can prevent indication of a fixed pattern during scrolling, for example, and can diffuse a lateral electric field effectively when there is a gradient difference between pixels, so as to display an image having high quality. The deterioration of image quality can be prevented particularly when an image having high-bit pixel data is displayed.

While the present embodiment exemplified the case in which the difference error data de (x, y) is calculated from a difference between the error data e (x, y) and the neighboring error data E (x, y), it is not limited to this case. The difference error data de (x, y) may be calculated by multiplying the error data e (x, y) and/or the neighboring error data E (x, y) by an appropriate coefficient, and then obtaining a difference between the error data e (x, y) and the neighboring error data E (x, y).

The present embodiment exemplified the case of N=8, M=4, D=4, and F=2 when the number of bits of input video signal data is defined as N, the number of bits when the number of gradients driven by the display element is represented by the binary number is defined as M, and the number of bits diffused as error by the error diffusion processing is defined as D; however, N, M, D, and F are not limited to the values above and may be any values. It is particularly preferable to satisfy the following conditions: N=8 to 12, M=4 to 6, D=4 to 10, and F=2 to 3.

While the present invention made by the inventors has been described above with reference to the embodiment, it should be understood that the present invention is not intended to be limited to the embodiment described above, and various modifications and improvements will be apparent to those skilled in the art within the scope of the present invention.

The present embodiment can provide a driving device for driving a display device in which deterioration of image quality is hardly distinguished at a portion in an image having a smooth and soft gradient, a liquid crystal display, and a driving method for driving a display device.

What is claimed is:

1. A liquid crystal display comprising:

a driving device configured to drive pixels in a liquid crystal display element;

an illumination optical system configured to cause illumination light to enter the liquid crystal display element; and a projection lens configured to project modulated light emitted from the liquid crystal display element, the driving device including:

an error diffusion unit configured to (i) generates difference error addition data by adding neighboring error data and difference error data to pixel data of a target pixel among the pixels in the liquid crystal display element, wherein the neighboring error data is error data of neighboring pixels and wherein the difference error data is difference error data of a pixel processed immediately before, and (ii) generate error diffusion data using data on a high-order bit side of the difference error addition data;

a frame rate controller configured to generate frame rate control data using the error diffusion data;

a sub-frame data generation unit configured to generate sub-frame data using the frame rate control data; and a drive controller configured to drive a plurality of sub-frames included in a frame using the sub-frame data so as to drive the target pixel in the liquid crystal display element, wherein the error diffusion unit calculates error data of the target pixel using data on a low-order bit side of the difference error addition data, and calculates difference error data to be added to pixel data of a pixel to be processed subsequently, using a difference between the error data of the target pixel and the error data of the neighboring pixels.

2. The liquid crystal display according to claim 1, wherein:

the liquid crystal display element includes a first sampling and holding portion and a second sampling and holding portion;

the first sampling and holding portion receives and holds sub-frame data corresponding to a predetermined sub-frame in a data transfer period of the predetermined sub-frame;

the first sampling and holding portion transfers the sub-frame data corresponding to the predetermined sub-frame to the second sampling and holding portion after a lapse of the data transfer period of the predetermined sub-frame;

the second sampling and holding portion holds the sub-frame data corresponding to the predetermined sub-frame; and the liquid crystal display element drives the predetermined sub-frame in a data transfer period of a sub-frame subsequent to the predetermined sub-frame, using the sub-frame data held in the second sampling and holding portion.

3. The liquid crystal display according to claim 2, wherein:

the liquid crystal display element further includes a voltage selection portion and a pixel electrode portion; and the voltage selection portion selects one of voltage lines in accordance with a value of the sub-frame data held in the second sampling holding portion, so as to apply a voltage for the selected voltage line to the pixel electrode portion.

4. A driving device for driving a display device, comprising:

an error diffusion unit configured to (i) generate difference error addition data by adding neighboring error data and difference error data to pixel data of a target pixel among pixels in a display element, wherein the neighboring error data is error data of neighboring pixels and wherein the difference error data is difference error data of a pixel processed immediately before, and (ii) generate error diffusion data using data on a high-order bit side of the difference error addition data;

a frame rate controller configured to generate frame rate control data using the error diffusion data;

a sub-frame data generation unit configured to generate sub-frame data using the frame rate control data; and a drive controller configured to drive a plurality of sub-frames included in a frame using the sub-frame data so as to drive the target pixel in the display element, wherein the error diffusion unit calculates error data of the target pixel using data on a low-order bit side of the difference error addition data, and calculates difference error data to be added to pixel data of a pixel to be processed subsequently, using a difference between the error data of the target pixel and the error data of the neighboring pixels.

5. The driving device according to claim 4, wherein the error diffusion unit uses a weighted average of pieces of error data of the neighboring pixels around the target pixel as the error data of the neighboring pixels.

6. The driving device according to claim 4, wherein:

the sub-frame data generation unit generates the sub-frame data such that:

a sub-frame is in a driving state when the sub-frame data is a first value, and the sub-frame is in a blanking state when the sub-frame data is a second value; and sub-frame in the blanking state immediately in front of or behind a sub-frame already in the driving state in the frame turns to the driving state, a drive gradient of the target pixel is increased by one.

7. A driving method for driving a display device, comprising the steps of:

generating difference error addition data by adding neighboring error data and difference error data to pixel data of a target pixel among pixels in a display element, wherein the neighboring error data is error data of neighboring pixels and wherein the difference error data is difference error data of a pixel processed immediately before;

generating error diffusion data using data on a high-order bit side of the difference error addition data;

generating frame rate control data using the error diffusion data;

generating sub-frame data using the frame rate control data; and driving a plurality of sub-frames included in a frame using the sub-frame data so as to drive the target pixel in the display element, the step of generating the error diffusion data including:

calculating error data of the target pixel using data on a low-order bit side of the difference error addition data; and calculating difference error data to be added to pixel data of a pixel to be processed subsequently, using a difference between the error data of the target pixel and the error data of the neighboring pixels.

* * * * *